US006127909A

United States Patent [19]

Vix

[11] Patent Number: 6,127,909

[45] Date of Patent: Oct. 3, 2000

[54] BREAKER MECHANISM FOR AN ELECTRIC CIRCUIT-BREAKER

[75] Inventor: Martin Vix, Schenkon, Switzerland

[73] Assignee: Schurter AG, Lucerne, Switzerland

[21] Appl. No.: 09/306,893

[22] Filed: May 7, 1999

[30] Foreign Application Priority Data

May 8, 1998 [CH] Switzerland ..... 1042/98

[51] Int. Cl.[7] ..... H01H 3/00

[52] U.S. Cl. ..... 335/185; 335/189

[58] Field of Search ..... 335/8–10, 23–35, 335/155, 167–176, 189–196; 200/336, 400

[56] References Cited

U.S. PATENT DOCUMENTS

| | | | |
|---|---|---|---|
| 2,131,800 | 10/1938 | Frank | 335/20 |
| 3,406,360 | 10/1968 | Simons | 335/16 |
| 3,752,947 | 8/1973 | Strobel . | |
| 4,048,599 | 9/1977 | Groth | 335/20 |
| 5,500,630 | 3/1996 | Edwards, Jr. et al. | 335/132 |
| 5,933,065 | 8/1999 | Duchemin | 335/190 |

FOREIGN PATENT DOCUMENTS

| | | |
|---|---|---|
| 0 703 592 | 3/1996 | European Pat. Off. . |

*Primary Examiner*—Lincoln Donovan
*Attorney, Agent, or Firm*—Morgan, Lewis & Bockius LLP

[57] ABSTRACT

The breaker mechanism (6) has a position to either side of a zero position and is distinguished in that it has a minimum number of few parts, and that it can be assembled from only one direction. This ensures a trip-free mechanism. Conversely, switching on is impossible when the breaker mechanism (6) is unlatched. The breaker mechanism (6) has an intermediate piece (15) that is assigned an alternating function in reference to the two positions. Together with a rotary handle (12), it forms a toggle lever joint with two effective ends.

12 Claims, 7 Drawing Sheets

BREAKER MECHANISM FOR AN ELECTRIC CIRCUIT-BREAKER

TECHNICAL FIELD

The present invention concerns a breaker mechanism for an electric circuit breaker with a position on both sides of a zero position that is especially designed to be multipolar and e.g. can be used as a motor circuit breaker with "off", "forward" or "reverse" positions.

STATE OF THE ART

Corresponding motor circuit breakers are prior art, however there is an ongoing need to improve them. One seeks to provide improvements by simplifying the design and streamlining and hence economizing their manufacture with as much automation as possible. At issue are the number of parts of the breaker mechanism, and how they are joined and engage. Assembly from only one direction is particularly advantageous.

PRESENTATION OF THE INVENTION

Given this background, the invention creates a breaker mechanism for a circuit breaker of the cited kind whose features are listed in patent claim 1.

The breaker mechanism according to the invention has a rotary handle, an operating lever, an intermediate piece, a latch and a actuating rod whereby:

- The rotary handle:
  - Is manually actuated,
  - Is mounted to a stationary rotary handle shaft and
  - Is articulated to the intermediate piece;
- The intermediate piece:
  - Forms a toggle lever with two effective ends together with the rotary handle, and
  - Alternately contacts the operating lever in the two positions with the two effective ends;
- The operating lever:
  - Has two ends,
  - One end is articulated to the latch, and
  - The other end is coupled to the actuating rod;
- The latch:
  - Is mounted on a latch axis that can be moved against the force of a first spring in a lengthwise direction away from the rotary handle axis, and
  - Can be latched against rotation on the latch axis; and
- The actuating rod:
  - Can be moved perpendicular to the lengthwise direction, and
  - Is forced directly or indirectly by two counteracting springs into a position corresponding to the zero position.

The breaker mechanism according to the invention is primarily distinguished by a minimum of parts, and it can be assembled from one direction. This provides a trip-free mechanism. Contrastingly, switching on is impossible if the breaker mechanism or its latch is not latched.

BRIEF EXPLANATION OF THE FIGURES

The invention will be further explained in the following with reference to exemplary embodiments in the drawings. Shown are.

In the figures, the same parts are provided with the same reference numbers.

EMBODIMENTS OF THE INVENTION

Figure 1:
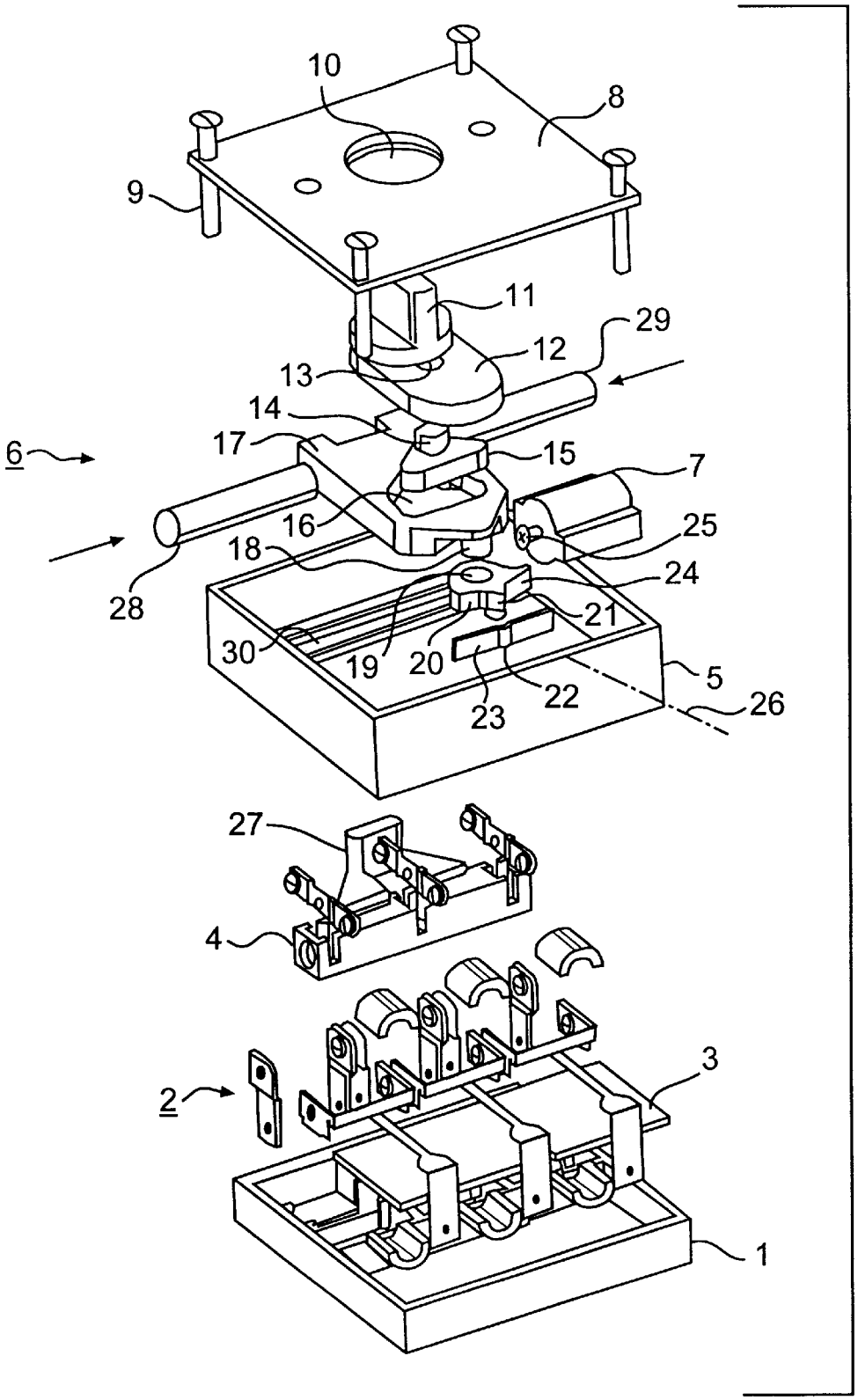
FIG. 1 An exploded view of a three-pole circuit breaker with a breaker mechanism according to the invention.

FIG. 1 shows an exploded view of a three-pole electrical circuit breaker that especially can be used as a motor circuit breaker with a position on each side of a zero position. The zero position preferably corresponds to the off position of the circuit breaker, and the positions to either side of the zero position represent two switched-on positions, e.g. forward and reverse of a connected electric motor.

The circuit breaker is modular with several stacked planes. Element 1 is a bottom housing part in the form of a flat shell open at the top. In this shell are three double switch contacts 2 between a middle open position and one "on" position to either side of the middle position. Furthermore, the bottom housing part 1 holds a unit 3 that serves to detect currents that flow via the switch contacts 2 into the two on positions and the voltages between them, and to generate control voltages from these quantities. Finally, the housing part 1 also holds an actuating rod 4 that moves in a lengthwise direction and bears parts of the switch contacts 2. By moving the actuating rod 4, the switch contacts 2 can be moved out of a middle open position into a position to either side of the open position.

In another housing part 5 also designed as an open shell, there is a breaker mechanism identified as 6. An undervoltage relay 7 electrically coupled to the unit 3 serves to latch and unlatch the breaker mechanism 6.

The circuit breaker 1 is sealed at the top by a cover plate 8. Screws 9 are used to screw the cover plate 8 to the top housing part 5 that is screwed to the bottom housing part; this fixes all the parts of the circuit breakers 1. The circuit breaker 1 can be completely assembled from the top, i.e., only from one direction.

A knob 11 extends upward (to the outside) through an opening 10 in the cover plate 8, and it is part of a rotary handle 12 of the breaker mechanism 6. The knob 11 holds the rotary handle 12 in the cover opening 10 and hence tightly holds it in the housing (rotary handle axis). The knob 11 can be manually moved to move the rotary handle 12.

A rotating pin 14 of a triangular intermediate part 15 fits in a hole 13 in the rotary handle 12, and the intermediate part pivots in an approximately trapezoidal recess 16 in the operating lever 17.

The bottom end of the operating lever 17 has a pin 18 that rotates in a hole 19 in a latch 20. At its bottom end, the latch 20 has a cam 21 that sits in a recess 22 of a plate spring 23 which is fixed to the top housing part 5 in a manner not shown. A molded-on part 24 on the latch 20 facing the undervoltage relay 7 forms a latch arrangement together with the armature 25 of the undervoltage relay 7 that can be latched or held in a latched state when the armature 25 is on and is unlatched when the armature 25 off. When unlatched, the latch 20 is free to pivot its cam 21 (latch axis) that rests in the recess 22 of the plate spring 23. When latched, the pivoting is blocked. In this state, the latch 20 can move against the force of the plate spring 23 somewhat away from the rotary handle shaft 11 in a lengthwise direction identified with 26.

Figure 2:
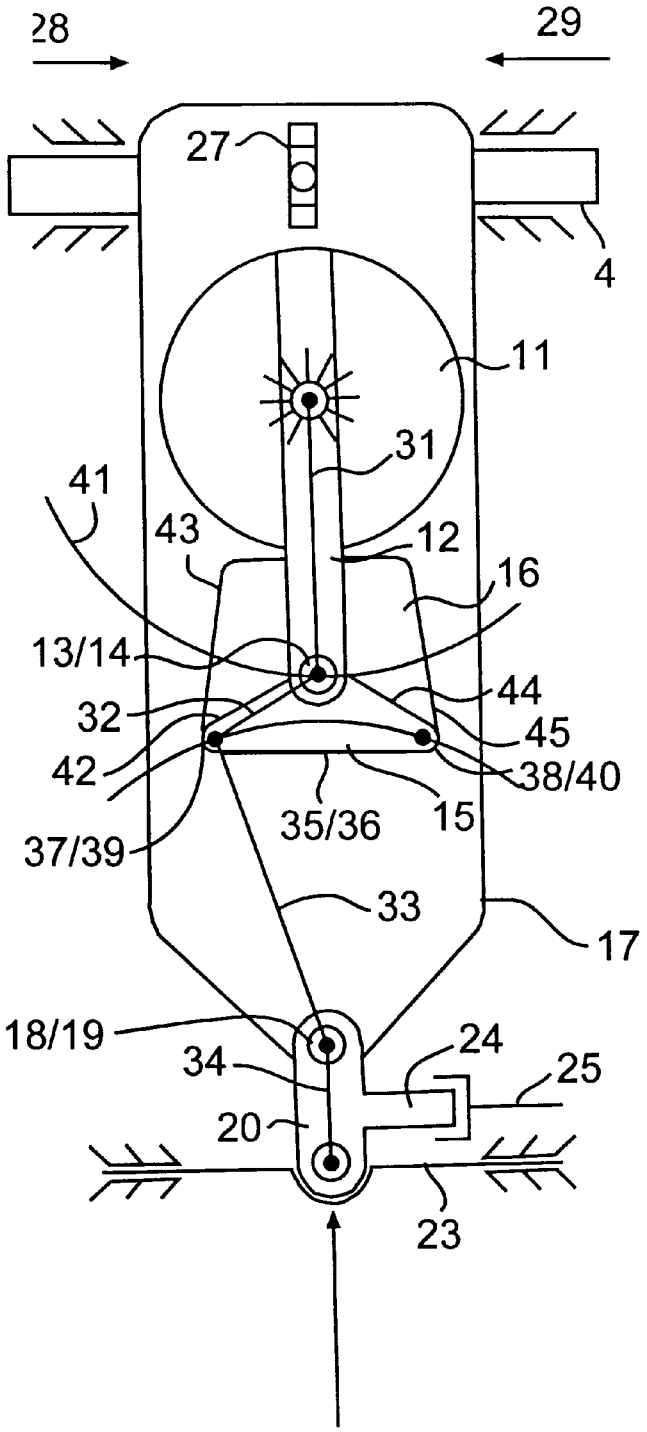
FIGS. 2–5 Schematic representation of the breaker mechanism in different positions.
Figure 4:
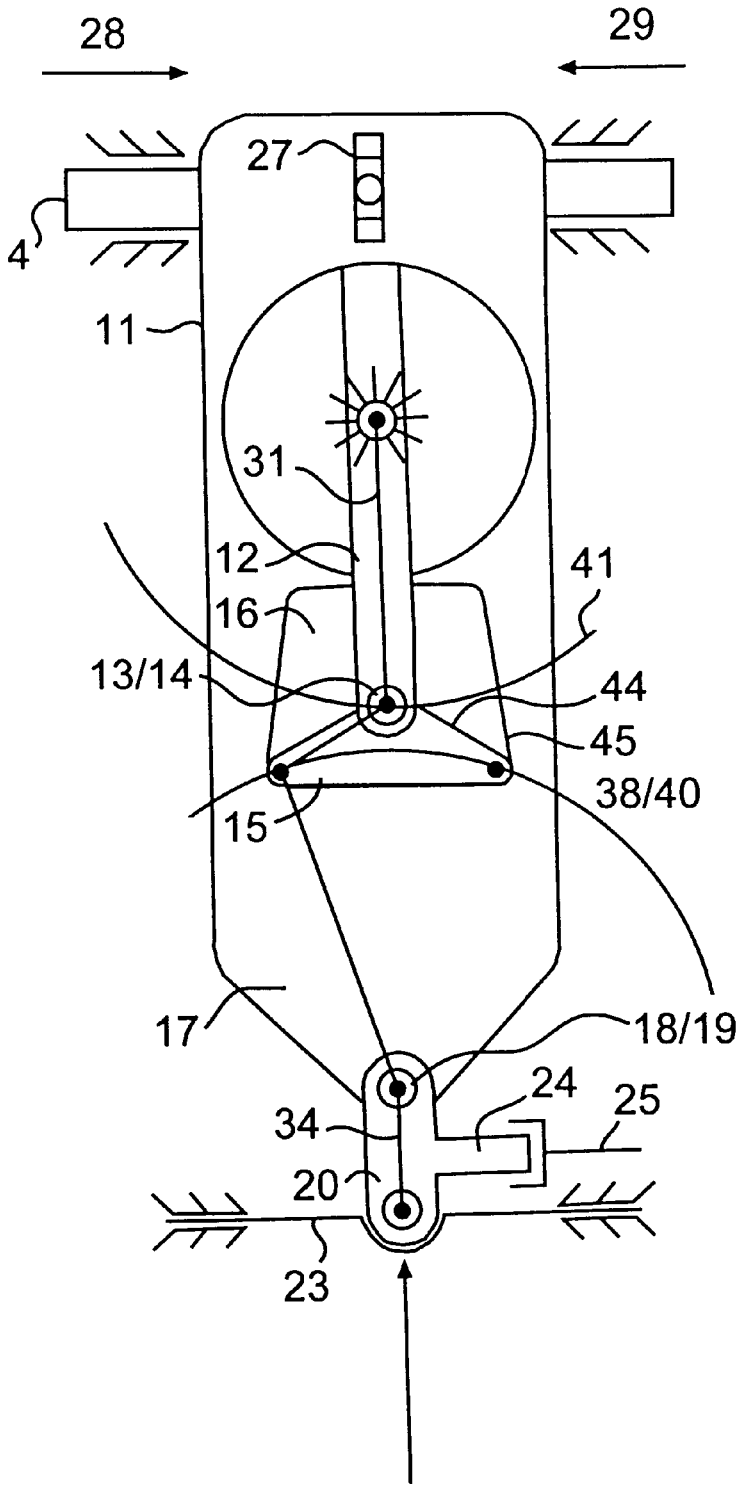

The top end of the operating lever 17 engages with a connecting cam 27 (that extends into the top housing part 5) of the actuating rod 4 so that it can be swung in reference to the actuating rod and moved somewhat in a lengthwise direction 26. As stated, the actuating rod 4 can be moved lengthwise in the bottom housing part 1 and hence perpendicular to the lengthwise direction 26. The actuating rod 4, its cam 27 or the top end of the operating lever 17 is also pressed by two counteracting springs 28 and 29 that abut the housing 5 and force the actuating rod 4 into a zero position (FIG. 2 and FIG. 4). In the zero position, the double switch contacts 2 in the bottom housing part are in an open position and can be closed starting from this position by moving the actuating rod 4 to the side in one or the other directions.

Figure 3:
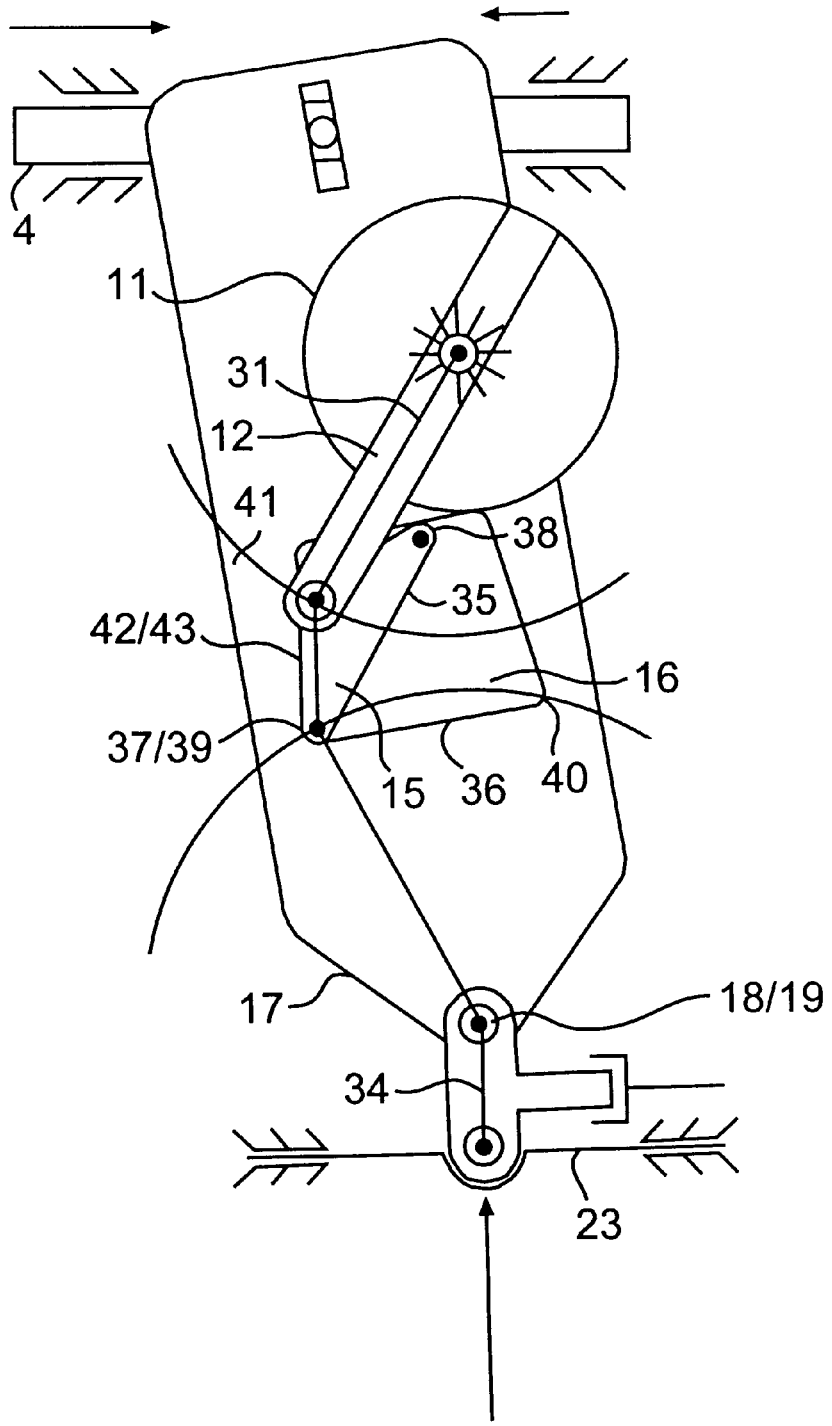
Figure 5:
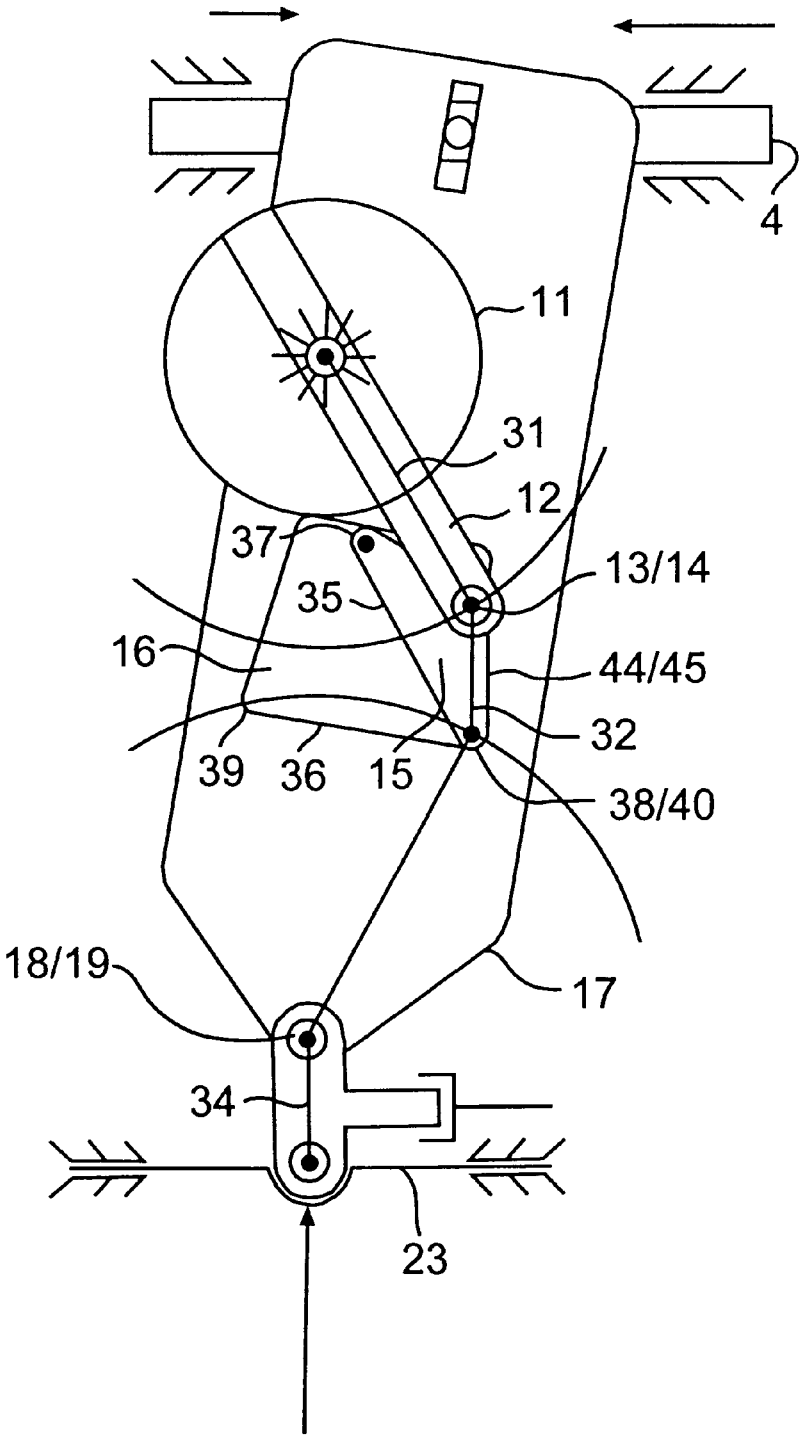

The function of the breaker mechanism 6 consisting of the rotary handle 12, the intermediate piece 15, the operating lever 17, the latch 20, the (first) spring 23, the actuating rod 4 and the two (second) springs 28 and 29 will be further explained in the following with reference to FIGS. 2–6. FIGS. 2 and 4 show the breaker mechanism 6 in a position that corresponds to the zero position of the circuit breakers 1, and FIGS. 3 and 5 show positions that correspond to the two switched positions of the circuit breakers 1 to the side of the zero position. Correspondingly in FIG. 2 and 4, the knob 11 and the operating lever 12 are aligned perpendicular to lengthwise direction 26 and can move to the right (FIG. 3) and left (FIG. 5) in reference to this direction 26.

The rotary handle 12, intermediate piece 15, operating lever 17 and latch 20 are all flat parts that transmit leverage in both switched positions to the sides of the zero position sometimes in different ways. To illustrate this, the acting levers are drawn as lines 31–34 in FIGS. 2–5.

In the position in FIG. 2, the base 35 of the triangular intermediate piece 15 whose tip is articulated to the rotary handle 12 (bearing 13/14) contacts the base 36 of the trapezoidal cut-out in the operating lever 17. Its two bottom rounded corners 37 and 38 extend in correspondingly rounded corners 39 and 40 of the cut-out 16. The corners 37,38 of the intermediate piece 15 can alternatingly rotate in the corners 39, 40 of the cut-out 16.

In reference to the position in FIG. 3, it should first be noted in FIG. 2 that the chain of leverage 31–34 between bearing 13/14 and bearing 18/19 passes via the left corner 37/39 of the intermediate piece 15 or cutout 16. It is also assumed that the latch 20/34 is latched and is hence blocked from rotating. If the rotary handle 12/31 and the bearing 13/14 are swung together on a circular arc 41 by turning the knob 11 to the right (clockwise), the intermediate piece 15 is also forced to swing on its left bottom corner 37 to the left. The right bottom corner 38 of the intermediate piece 15 swings out of the corner 40 of the trapezoidal cut-out 16. Since the rotary handle 12/31 and the intermediate piece 15/32 form a toggle lever that is moved out of its extended position (deadpoint), the intermediate piece or its momentarily effective lever 32 exert pressure on the left bottom corner 39 of the trapezoidal cut-out 16 in the operating lever 17/33 and forces it to move. The operating lever 17/33 does this by swinging to the left on bearing 18/19, and it entrains the actuating rod 4 against the force of the second spring 28; in addition, the bottom end (bearing 18/19) of the operating lever 17/33 temporarily escapes the force of the first spring 23. After passing through its extended position, the first spring 23 supports continued rotation that is finally limited when the left side leg 42 of the triangular intermediate piece 15 contacts the left side leg 43 of the trapezoidal cut-out 16. This position is shown in FIG. 3. In this position, the actuating rod 4 is moved until the double-switch contacts 2 shown in FIG. 1 are in one of their two cited "on" positions.

Since the first spring 23 is substantially stronger than the two second springs 28, 29, the breaker mechanism 6 cannot independently return to the zero position in FIG. 2 from the position in FIG. 3 since the extended position of the knuckle lever 32/33 must be overcome against the force of the first spring 23. The breaker mechanism 6 is accordingly locked in the position in FIG. 3.

FIGS. 4 and 5 show the same described switching procedure starting from the zero position in FIG. 4, but in the other direction into the other of the two positions of the circuit breaker. The leverage chain 31–34 passes via the right bottom corner 38 of the triangular intermediate piece 15 or the right bottom corner 40 of the trapezoidal cut-out 16 in the operating lever 17. Its effective lever arm 33 extends between the bearing 18/19 and the corners 38/40. In the stable position in FIG. 5, the triangular intermediate piece 15 contacts the right side leg 45 of the trapezoidal cut-out 16 with its right side leg 44.

It can be seen that the intermediate piece 15 in the described embodiment has an alternating function in reference to the two position in FIG. 3 and FIG. 5. Together with the rotary handle 12/31, the intermediate piece 15 forms a toggle lever with two effective ends that are formed by the two bottom corners 37, 38. The two corners 37 and 38 also represent bearing axes. Given this possibility, the two corners 37 and 38 may not be fixed to the operating lever 17. The described loose fit of the two corners 37 and 38 in the bottom corners 39, 40 of the trapezoidal cut-out 16 in the operating lever 17 ensures this. The dual function of the intermediate pieces 15 and its special interaction with the operating lever 17 advantageously save parts that otherwise would be necessary to realize the same function. This produces a simple and economical design of the overall lock construction.

The shapes of the intermediate piece (15) and the cutout (16) do not necessarily have to be strictly triangular or trapezoidal. It is enough for the two shapes to be harmonized so that the described function is realized. It is in particular inconsequential how the top edge of the cut-out in the figures is shaped. A flat support for the base or the side leg of both parts is also unnecessary. The intermediate piece could hence also be star-shaped, for example. Finally, of course, a molded-on part of the operating lever could e.g. engage with a recess in the intermediate piece. The corresponding is true for the other connections of the described functional elements.

Figure 6:
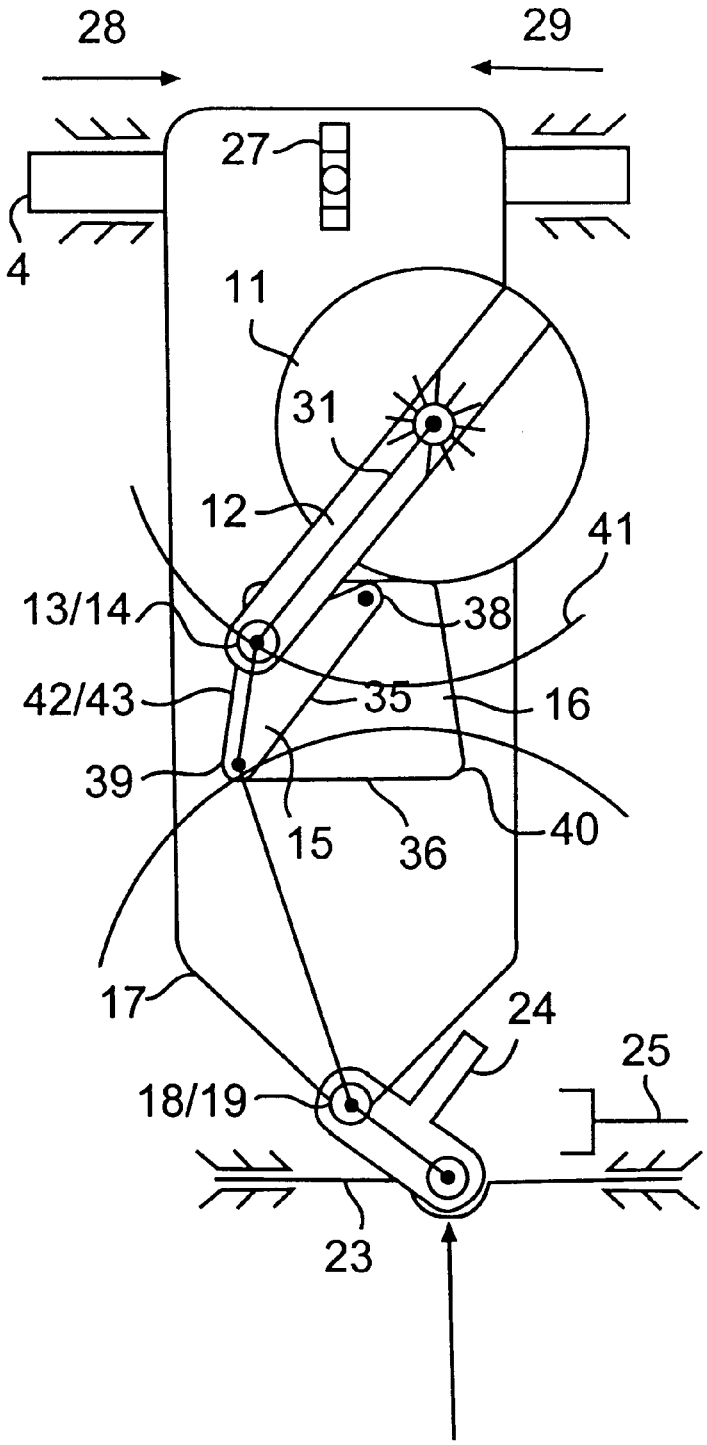
FIG. 6 Schematic representation of the breaker mechanism when released.

FIG. 6 shows the breaker mechanism 6 in a released position that e.g. is reached in case of a fault from the position in FIG. 3 under the force of the loaded second spring 28. As can be seen, the actuating rod 4 is pushed back by spring 28 toward its zero position in FIG. 3 until the switch contacts 2 that it contacts can open. This movement of the actuating rod 4 was enabled by releasing the latching 24/25 of the latch 20/34 and circumventing the described locking of the toggle lever and without rotating the rotary handle 12/31 (trip-free). The latch 20/34 is freed to pivot on its cam 22 which enables the operating lever 17/33 to yield to the pressure of the actuating rod 4 and rotate back on the bearing 13/14 on the bottom end of the rotary handle 12/31. If conversely one attempts to move the switch out of its zero position in FIG. 3 when the lock is released, only the position in FIG. 6 is reached. This means that the switch cannot be moved to its "on" position when the lock is released.

A comparable released position arises proceeding from the position in FIG. 4 with a released lock, or proceeding from the position in FIG. 5 after releasing the latching. The operating lever 17/33 is symmetrically moved to the right beyond the middle marked by line 26 in contrast to its position in FIG. 6.

Figure 7:
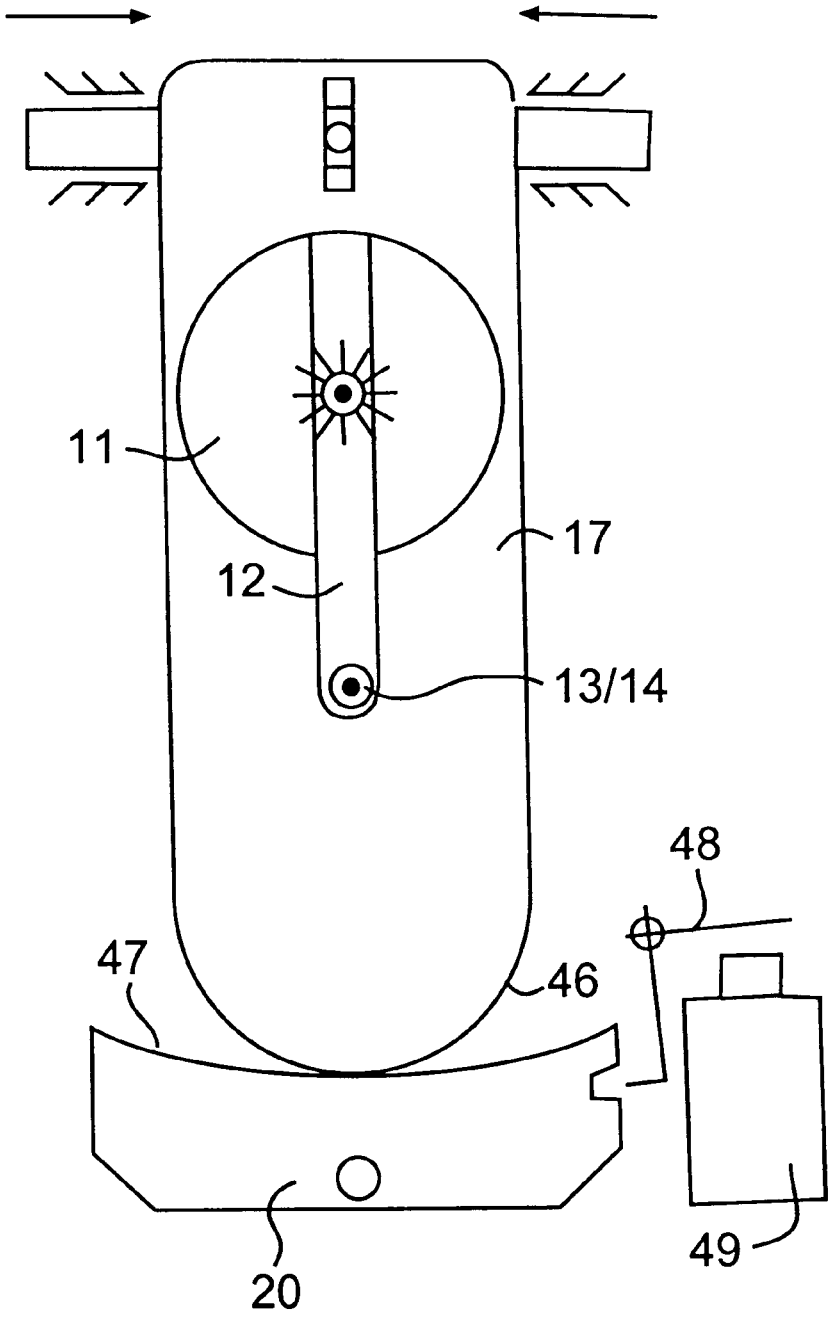
FIG. 7 Schematic representation of the breaker mechanism with a specially designed rotary handle, latch and locked breaker mechanism.

FIG. 7 shows specific embodiments of the rotary handle 12 and the latches 20. The rotary handle 12 has been lengthened up to the latch 20, and its convex radius 46 contacts a concave radius 47 of the latch 20. The two radii 46, 47 are designed so that the latch 20 (swung e.g. as in FIG. 6) is necessarily swung from its swung position in FIG. 6 into its neutral position in FIG. 2 or FIG. 4 in which it can be relatched. The corresponding molded parts on the rotary handle 12 and on the latch 20 can be moved toward the operating lever 17 and the intermediate piece 15. In the drawing in FIG. 1, they can be in a plane above these elements. In FIGS. 2–6, they are left out to better identify the operating lever 17 and the intermediate piece 15.

Finally, FIG. 7 also shows a possible way of latching the latch 20 where the armature 48 of an undervoltage relay 49 is an integral part of the latching.

What is claimed is:

1. A breaker mechanism for an electric circuit breaker having a first switching position on a first side of a middle switching position and a second switching position on a second side of the middle switching position, the breaker mechanism comprising:

a manually actuated rotary handle mounted to a stationary shaft;

an intermediate piece articulated to the rotary handle, the intermediate piece having first and second actuating ends and forming together with the rotary handle a toggle-lever with first and second effective ends, the effective ends of the toggle lever being formed by the actuating ends of the intermediate piece;

an operating lever having a first operating lever end, a second operating lever end, a first abutement and a second abutement;

a latch lever articulated to the first operating lever end and mounted to a latch axis that can be moved against force of a first spring in a first direction away from the stationary shaft of the rotary handle, the latch lever being capable of being latched against rotation around the latch axis; and an actuating rod coupled to the second operating lever end and movable perpendicular to the first direction, wherein the actuating rod is forced directly or indirectly into a position corresponding to the middle switching position by two counteracting springs, wherein the actuating rod is forced into a position corresponding to the first switching position when the intermediate piece acts with its first effective end on the first abutement of the operating lever, and wherein the actuating rod is forced into a position corresponding to the second switching position when the intermediate piece acts with its second effective end on the second abutement of the operating lever.

2. The breaker mechanism according to claim 1, wherein the rotary handle, the intermediate piece, the operating lever, the latch lever, and the actuating rod are movable in parallel planes.

3. The breaker mechanism according to claim 1, wherein the rotary handle, the intermediate piece, the operating lever, the latch lever, and the actuating rod are situated in a flat housing part with an open-shell shape and closed with a cover plate.

4. The breaker mechanism according to claim 3, wherein the stationary shaft of the rotary handle is mounted in an opening of the cover plate.

5. The breaker mechanism according to claim 1, wherein the intermediate piece pivots in a cut-out area of the operating lever.

6. The breaker mechanism according to claim 1, wherein the intermediate piece has a triangle shape with a base, two side legs, a tip opposite the base, and two rounded corners connecting the base with the two side legs, wherein the tip engages with the rotary handle, and the two rounded corners form the first and second actuating ends of the intermediate piece.

7. The breaker mechanism according to claim 1, wherein the intermediate piece pivots in a cut-out area of the operating lever, wherein the cut-out area has a trapezoidal shape with a base, two side legs, and two rounded corners connecting the base with the two side legs, and wherein the two rounded corners form the first and second abutements of the operating lever.

8. The breaker mechanism according to claim 1, wherein the intermediate piece has a triangle shape with a base, two side legs, a tip opposite the base, and two rounded corners connecting the base with the two side legs, wherein the tip engages with the rotary handle, and the two rounded corners form the first and second actuating ends of the intermediate piece, wherein the intermediate piece pivots in a cut-out area of the operating lever, wherein the cut-out area has a trapezoidal shape with a base, two side legs, and two rounded corners connecting the base with the two side legs, wherein the two rounded corners of the cut-out area form the first and second abutements of the operating lever, and wherein the two rounded corners of the intermediate piece fit the two rounded corners of the cut-out area of the operating lever.

9. The breaker mechanism according to claim 8, wherein the base of the intermediate piece contacts the base of the cut-out area of the operating lever in the middle switching position of the circuit breaker, and one of the two side legs of the intermediate piece alternately contact one of the two side legs of the cut-out area in one of the first and second switching positions.

10. The breaker mechanism according to claim 1, wherein the latch lever has a latching position parallel to the first direction but can swing out of the latching position to a swung out position upon unlatching, wherein the rotary handle has a first position corresponding to the first and the second switching positions and a second position corresponding to the middle switching position, and wherein the rotary handle contacts the latch lever in such a manner that the rotary handle carries the latch lever from the swung out position to the latching position when the rotary handle is turned after unlatching from said first position into said second position.

11. The breaker mechanism according to claim 1, further comprising an undervoltage relay for latching the latch lever, wherein an armature of the undervoltage relay is a part of a latching action, and the latch is released when the armature is removed.

12. The breaker mechanism according to claim 1, further comprising at least one switch contact, and wherein the actuating rod actuates said at least one switch contact when the actuation rod is moved.

* * * * *